US008831257B2

(12) United States Patent
Lee et al.

(10) Patent No.: US 8,831,257 B2
(45) Date of Patent: Sep. 9, 2014

(54) EXTERIOR POWER SUPPLY FOR HEARING AID

(76) Inventors: Chum Lee, Taipei County (TW); Huey-Ling Kao Ulrey, Scottsdale, AZ (US)

( * ) Notice: Subject to any disclaimer, the term of this patent is extended or adjusted under 35 U.S.C. 154(b) by 270 days.

(21) Appl. No.: 13/273,772

(22) Filed: Oct. 14, 2011

(65) Prior Publication Data

US 2012/0033839 A1 Feb. 9, 2012

Related U.S. Application Data

(63) Continuation-in-part of application No. 12/320,956, filed on Feb. 10, 2009, now abandoned.

(51) Int. Cl.
*H04R 25/00* (2006.01)
*H04R 31/00* (2006.01)

(52) U.S. Cl.
CPC ..... *H04R 31/006* (2013.01); *H04R 25/602* (2013.01); *H04R 2225/33* (2013.01); *H04R 2225/31* (2013.01)
USPC ..... 381/317; 381/330; 439/500; 439/504; 439/628; 429/100; 368/64

(58) Field of Classification Search
USPC ..... 381/317–330; 439/504, 500, 628; 429/100; 368/64
See application file for complete search history.

(56) References Cited

U.S. PATENT DOCUMENTS 3,823,691 A 7/1974 Morgan
4,946,396 A * 8/1990 Saitoh ..... 439/500
5,296,315 A * 3/1994 Rein ..... 429/100
6,007,373 A * 12/1999 Chew ..... 439/504
6,359,992 B1 3/2002 Preves et al.
6,366,676 B1 4/2002 Neilson et al.
7,354,301 B2 * 4/2008 Noguchi et al. ..... 439/500
8,351,302 B2 * 1/2013 Fischer ..... 368/64
2003/0156727 A1 * 8/2003 Vonlanthen ..... 381/330
2006/0256989 A1 11/2006 Olsen et al.
2008/0311966 A1 12/2008 Klein

FOREIGN PATENT DOCUMENTS

CH 669296 A5 2/1989

* cited by examiner

*Primary Examiner* — Eugene Lee
*Assistant Examiner* — Fang-Xing Jiang
(74) *Attorney, Agent, or Firm* — Bacon & Thomas, PLLC

(57) ABSTRACT

An exterior power supply for a hearing aid has a battery-shaped conductor, two thin power contacts, and a DC power source. The battery-shaped conductor is received in a battery container of the hearing aid and has a top electrode and a bottom electrode. The thin power contacts are mounted to the battery-shaped conductor and respectively and electronically connected to the top and bottom electrodes of the battery-shaped conductor. Each thin power contact has a thickness matching a gap between an opening and a door of the battery container of the hearing aid. The DC power source is electronically connected to the battery-shaped conductor through a power wire and the thin power contacts to output DC power to the top and bottom electrodes of the battery-shaped conductor. Therefore, the hearing aid obtains DC power from the battery-shaped conductor and the button cell is not replaced frequently.

7 Claims, 7 Drawing Sheets

EXTERIOR POWER SUPPLY FOR HEARING AID

This application is a continuation-in-part application of application Ser. No. 12/320,956, filed Feb. 10, 2009, now abandoned.

BACKGROUND OF THE INVENTION

1. Field of the Invention

The present invention relates to the field of a battery-powered hearing aid, and more particularly to an exterior power supply for a battery powered hearing aid.

2. Description of Related Art

A battery-powered hearing aid commonly requires button cell battery used as power source thereof. In general, the user replaces the button cell battery of the hearing aid when he or she can no longer hear sounds clearly. Most of the button cell batteries contain mercury, which is a pollution source. If the user uses the non-rechargeable battery, he or she has to pay more money to buy the button cell batteries.

Although some types of the button cell batteries are rechargeable, a capacity thereof is too small to provide a long use term so that the rechargeable button cell has to be often accessed from a battery container of the hearing aid. According to statistics, about 40% of hearing aid fixing is to replace a battery door of the battery container of the hearing aid.

With reference to FIGS. 7*f* and 7*g* of the US patent publication (Publication No. 2008/0311966 A1), a rechargeable battery assembly for a headset is proposed and has a casing 83*a*, a power conducting pole 82*a*, a power socket 36 and a power wire 38 with a power plug 37. The power socket is embedded inside the casing for receiving the power plug of the power wire 38 and electronically connected to the batteries 62 inside the casing. The casing uses the power socket so that a battery door is not required.

However, most of the hearing aids still have battery doors. The original problem of fixing battery doors frequently is not solved by the battery assembly of the cited US patent publication.

To overcome the shortcomings, the present invention provides an exterior power supply for hearing aid to mitigate or obviate the aforementioned problems.

SUMMARY OF THE INVENTION

The main objective of the present invention is to provide an exterior power supply for a battery powered hearing so that a battery door of a battery container of the hearing aid is not closed or opened frequently.

The exterior power supply for a hearing aid has a battery-shaped conductor, two thin power contacts, and a DC power source. The battery-shaped conductor is received in a battery container of the hearing aid and has a top electrode and a bottom electrode. The thin power contacts are mounted to the battery-shaped conductor and respectively and electronically connected to the top and bottom electrodes of the battery-shaped conductor. Each thin power contact has a thickness matching a gap between an opening and a door of the battery container of the hearing aid. The DC power source is electronically connected to the battery-shaped conductor through a power wire and the thin power contacts to output DC power to the top and bottom electrodes of the battery-shaped conductor. Therefore, the hearing aid obtains DC power from the battery-shaped conductor and the button cell is not replaced frequently.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
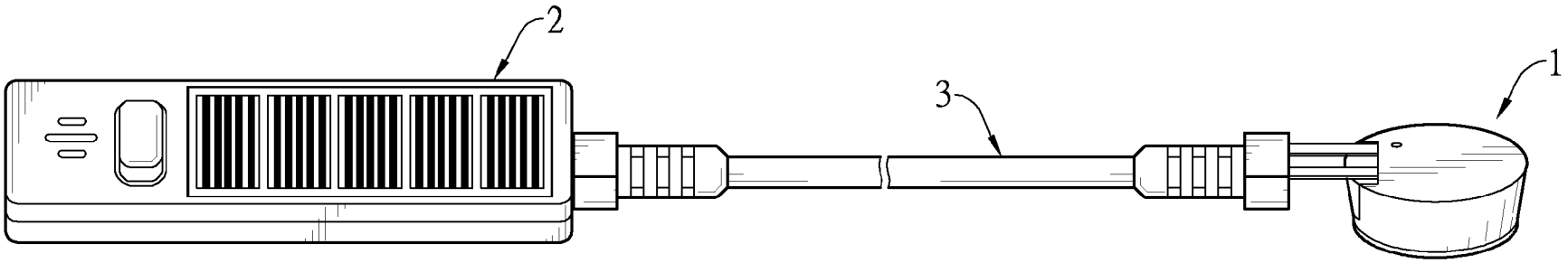
FIG. 1 is a perspective view showing an exterior power supply to a hearing aid in accordance with the present invention.
Figure 2A:
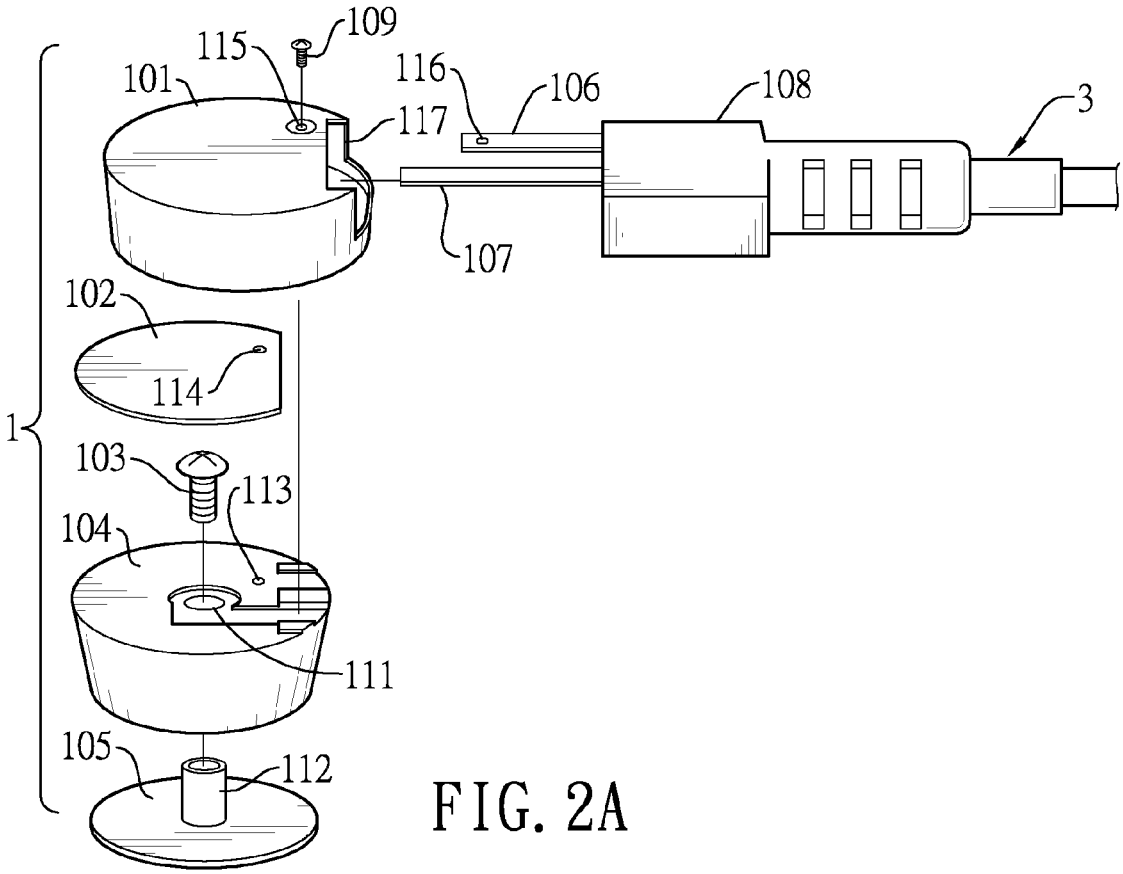
FIG. 2 is an exploded perspective view of the power supply electrode contact in accordance with the present invention.
Figure 2B:
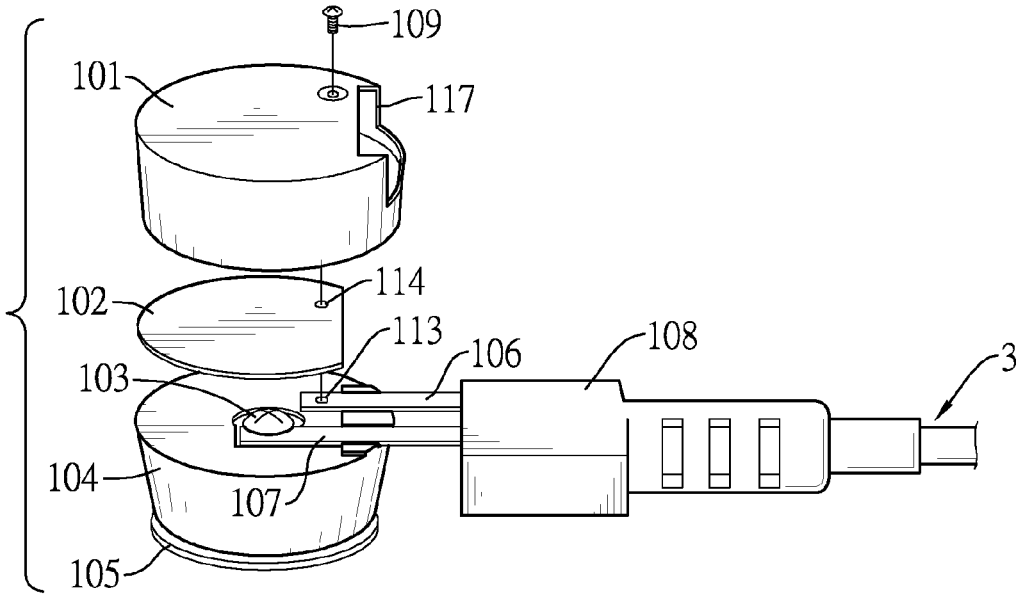
Figure 4:
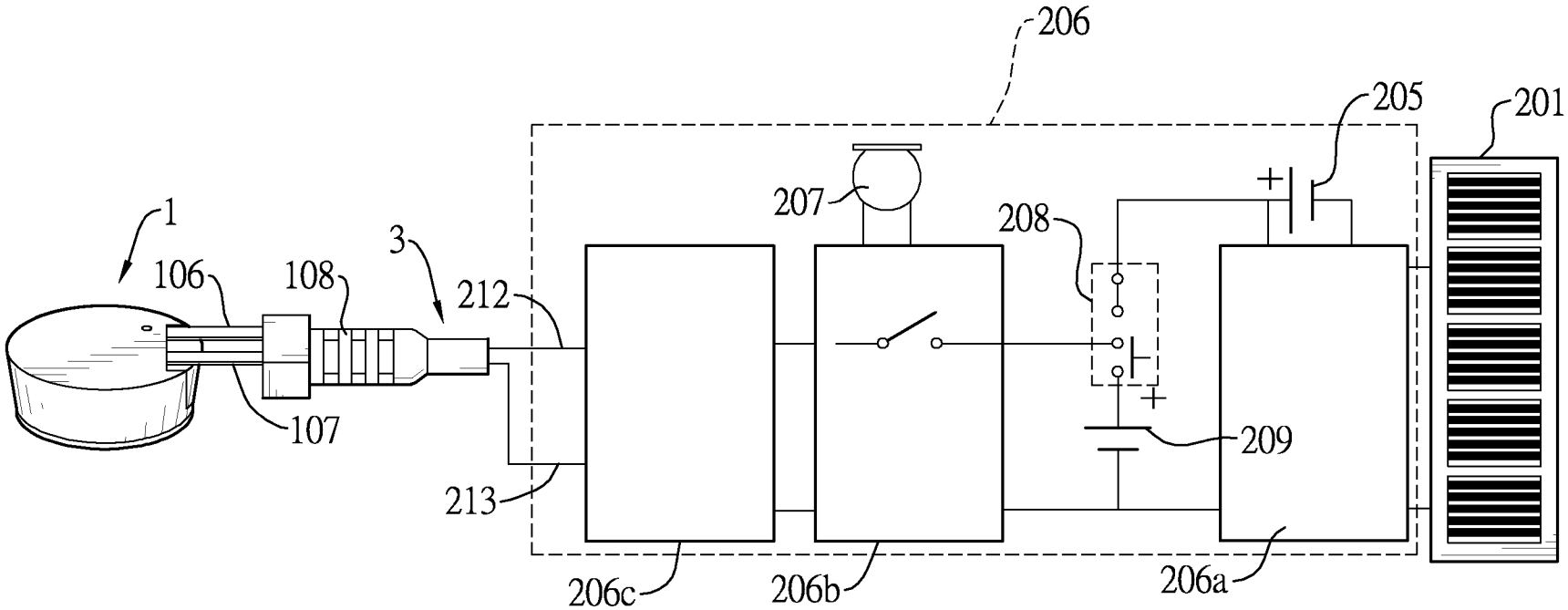
FIG. 4 is a circuit diagram of the exterior power supply in accordance with the present invention.

With reference to FIGS. 1, FIG. 2A and FIG. 2B, an exterior power supply in accordance with the present invention has a DC power source 2, a power wire 3, two thin power contacts 106, 107 and a battery-shaped conductor 1. With further reference to FIG. 4, the DC power source 2 has a positive electrode 212 and a negative electrode 213 respectively connected to the power wire 3. The two thin power contacts 106, 107 are respectively and electronically connected to the positive and negative electrodes 212, 213 through the power wire 3. That is, two rear ends of the thin power contacts 106, 107 are respectively connected to the power wire 3. A through hole 116 is formed at one of two front ends of the thin power contacts 106.

The power wire 3 has two PVC plastic heads 108. The rear ends of the two thin power contacts 106, 107 are inserted into one of the PVC plastic heads 108.

The battery-shaped conductor 1 is manufactured according to the size of button cell used by the hearing aid (such as battery number 675, 13, 312, 10, and 5 etc.). The battery-shaped conductor 1 has an insulation body 104 having an insulation plate 102, a conductive plate 105 and an insulation housing 101.

The insulation body 104 further has a first through hole 111, and a second hole 113 on a top of the insulation body. One of the two front ends of the two thin power contacts 107 is mounted on the top of the insulation body 104 and next to the first through hole 111. The front end of the other thin power contact 106 is mounted on the second hole 113 and the through hole 116 of the thin power contact 106 is aligned with the second hole 113.

The conductive plate 105 is mounted on a bottom of the insulation body 104 and further has a hollow pole 112 inserted to the through hole 111. A first screw 103 is threaded into the first through hole 111 of the insulation body 104 from the top of the insulation body 104 and then touches the front end of the thin power contact 107. Therefore, the thin power contact 107 is electronically connected to the conductive plate 105 through the first screw 103. The conductive plate 105 is used as a bottom electrode of the battery-shaped conductor 1.

The insulation plate 102 covers the top of the insulation body and two front ends of the thin power contacts 106, 107 in part. The insulation plate 102 has a hole 114 aligned with the through hole 116 of the rear end of the thin power contact 106 and the second through hole 113 of the insulation body 104.

The insulation housing 101 covers the insulation plate 102, the front ends of the thin power contacts 106, 107, the top and outsides of the insulation body 104. The insulation housing 101 further has a side opening 117 through which the thin power contacts 106, 107 pass, and a through hole 115 aligned with the hole 114 of the insulation plate 102. A second screw 109 is threaded into the through hole 115 of the insulation housing 101, the hole 114 of the insulation plate 102, the through hole 116 of the front end of the thin power contact 106 and a second hole 113 of the insulation body 104.

Therefore, a top of the second screw 109 on the insulation housing is used as a top electrode. The top of the second screw 109 and the conductive plate 105 on the bottom of the insulation body 104 are electronically connected to the positive and negative electrodes 212, 213 through the two thin power contacts 106, 107 and the power wire 3, with further reference to FIG. 4.

Figure 3:
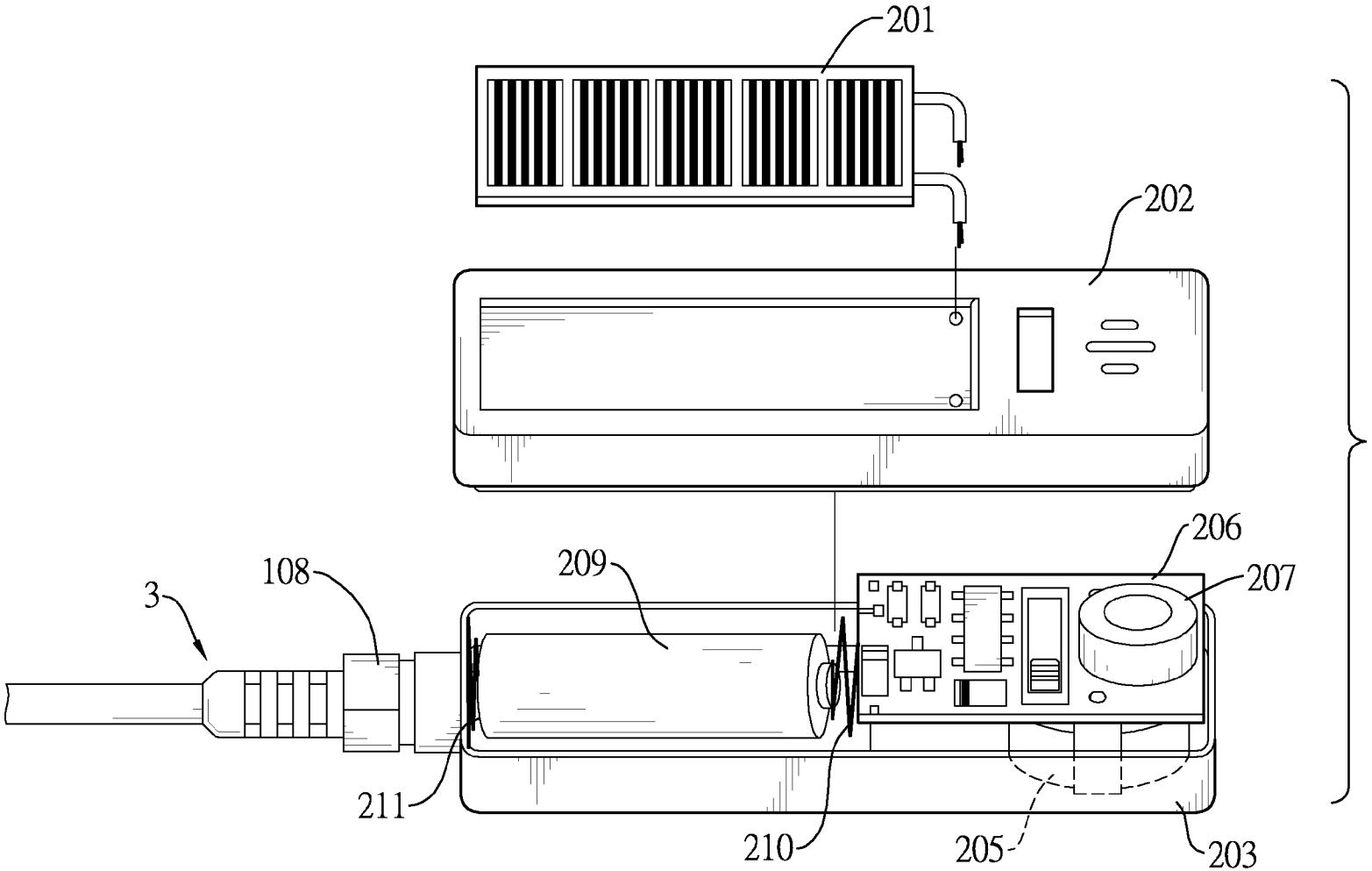
FIG. 3 is an exploded perspective view of the exterior power supply in accordance with the present invention.

With reference to FIG. 3, the DC power source 2 is a solar power supply and has an upper housing 202, a lower housing 203 covered by the upper housing 202, a PCB 206, a power switch 208, a solar panel 201, a rechargeable battery cell 205 and a regular battery 209. The power wire 3 is mounted on one side of the lower housing 203. The solar panel 201 is mounted on a top of the upper housing 202 and electronically connected to the PCB 206 mounted inside the lower housing 203. The rechargeable battery cell 205 is mounted inside the lower housing 203 and electronically connected to the PCB 206 and the power switch 208. The regular battery 209 can be replaceable from the lower housing 203. The rechargeable battery cell 205 has the positive electrode and negative electrode respectively and electronically connected to the power wire 3 through the power switch 208 and the PCB 206. The regular battery 209 is mounted inside the lower housing 203 and has the positive electrode 210 and negative electrode 211 respectively and electronically connected to the power wire 3 through the power switch 208 and the PCB 206. The power switch 208 has three switching nodes, a first one is connected to the rechargeable battery cell 205, a second one is connected to the regular battery 209 and a third one is connected to a none node (power off).

With further reference to FIG. 4, the PCB 206 has a power charging circuit 206*a*, an auto loud noise controlling unit 206*b*, a microphone 207 and a regulator circuit 206*c*.

The power charging circuit 206*a* regulates output voltage of the rechargeable battery cell 205 to avoid shortening the usage of the chargeable battery cell 205.

The auto loud noise control circuit 206*b* is electronically connected to the microphone 207 to obtain the background noise, calculate the volume of the background noise, and control the background noise under 84 dB to power on or power off The regulator circuit 206*c* has a setting voltage circuit and a voltage regulator to boost voltage of the rechargeable battery cell 205 (1.2V) and/or the regular battery 209 (1.5V) to 1.8V and then the regulator circuit 206*c* regulates 1.8V to 1.4V and outputs the 1.4V voltage to the battery-shaped contactor 1 through the power wire 3. That is, when the user uses the power switch 208 to switch to the first switching node, 1.2V is boosted to 1.8V and then regulated to 1.4V to be output to the power wire 3. 1.4 voltage is a driven voltage of the hearing aid. When the user uses the power switch 208 to switch to the second switching node, 1.5V is boosted to 1.8V and then regulated to 1.4V to be output to the power wire. Therefore, the DC power source always outputs 1.4V DC power to the battery-shaped conductor 1. In general, the driven voltage of the hearing aid is 1.1V to 1.6V, and the 1.4V is one selection thereof Therefore, the user can use the power switch 208 to select rechargeable battery cell 205 or the regular battery 209 to output the DC power.

Figure 5A:
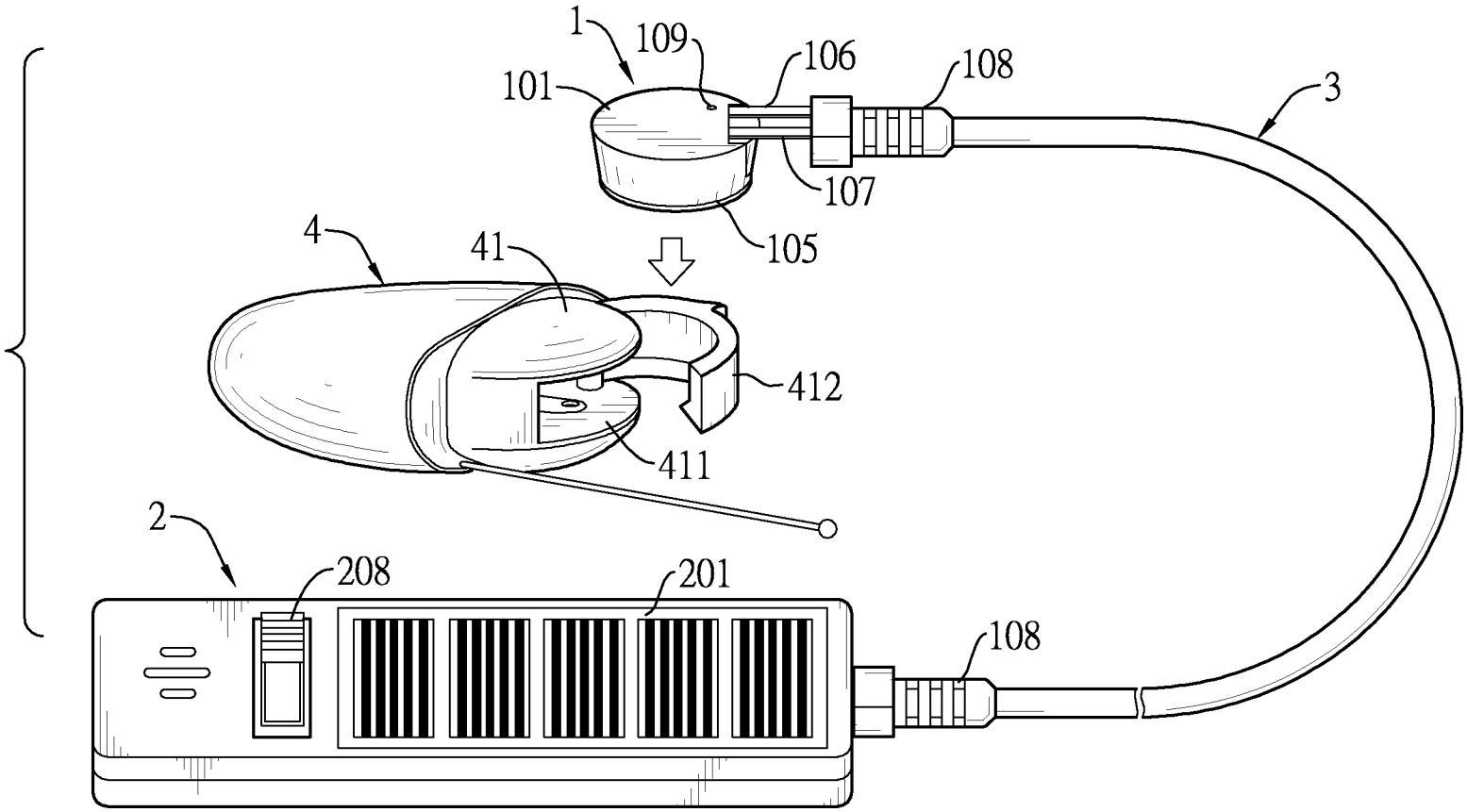
FIGS. 5A to 5C are operational views of the exterior power supply in accordance with the present invention.
Figure 5B:
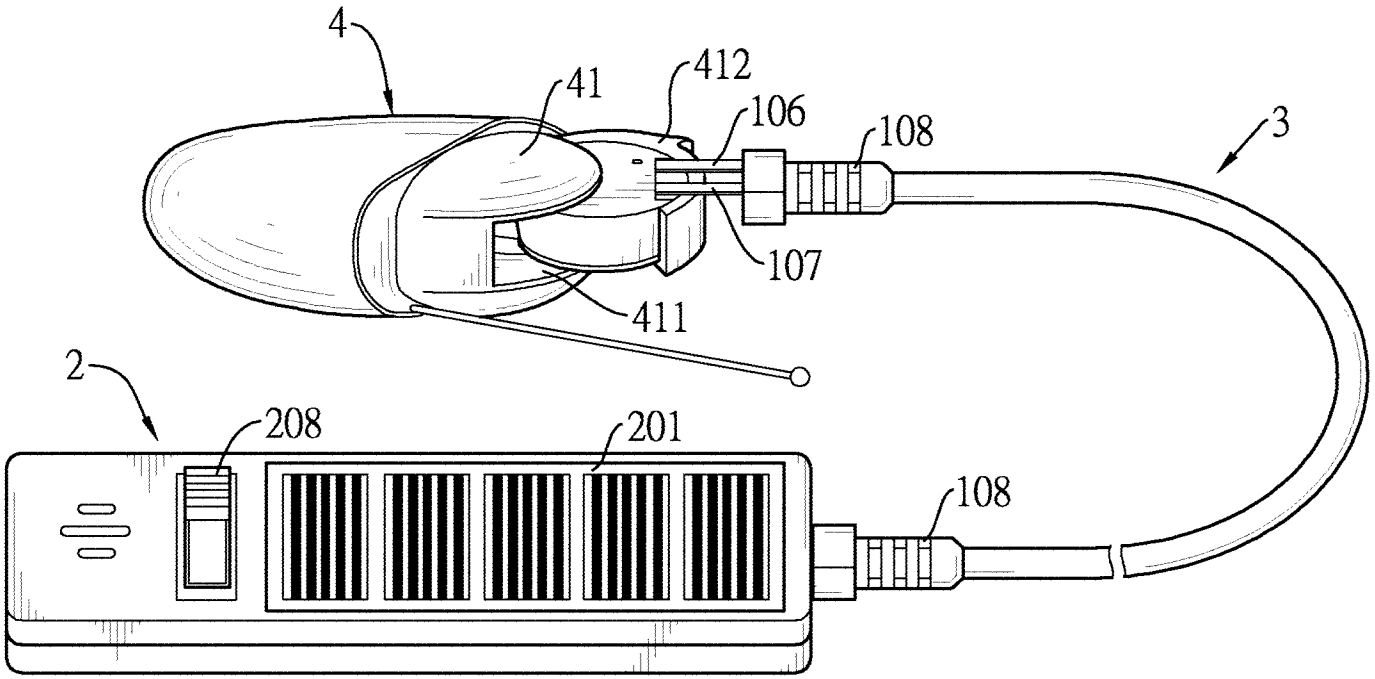
Figure 5C:
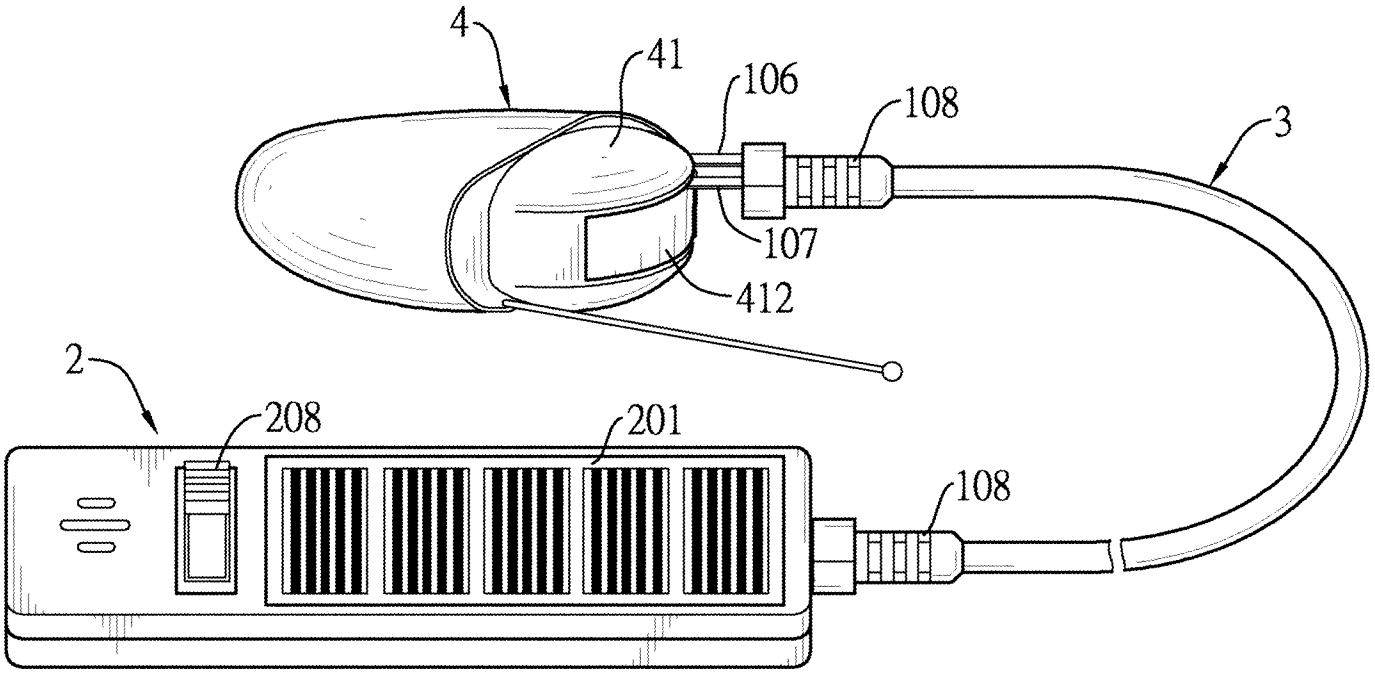

With reference to FIGS. 5A and 5B, a hearing aid 4 has a battery container 41 having an opening 411 and a door 412 selectively closing the opening 411. A gap (about 0.05 mm to 0.1 mm) exists between the door 412 and the opening 411. A thickness of each thin power contact 106, 107 is thinner than the gap so that the thin power contacts 106, 107 pass through the gap. Therefore, the battery-shaped conductor 1 is received inside the battery container 41 from the opening 411 and the door 412 is easily closed on the opening 411, as shown in FIG. 5C. The DC power source 2 outputs DC power to the hearing aid 4 so the door 412 does not open and close frequently.

The DC power source 2 can be hooked on the collar, the sleeve, or the front of the clothes to avoid hooking up with the wire. Based on foregoing description, the exterior power supply for the hearing aid not only uses solar power or battery but also powers off temporarily when the background noise is overloaded and powers on automatically once the background noise volume is back to the normal level. This protection can protect the hearing aid user's hearing capacity.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An exterior power supply for hearing aid, comprising:

a battery-shaped conductor adapted to be received in a battery container of a hearing aid and having a top electrode and a bottom electrode;

two thin power contacts mounted to the battery-shaped conductor and respectively and electronically connected to the top and bottom electrodes of the battery-shaped conductor, wherein each thin power contact has a thickness being thinner than a gap between an opening and a door of the battery container of the hearing aid; and a DC power source electronically connected to the battery-shaped conductor through a power wire and the thin power contacts to output DC power to the top and bottom electrodes of the battery-shaped conductor;

wherein the battery-shaped conductor further comprises:

an insulation body further having a first through hole formed through the insulation body, wherein one of front ends of the thin power contacts is mounted on a top of the insulation body and next to the first through hole; and a second hole formed on the top of the insulation body, wherein the front end of the other thin power contact is mounted in the second hole;

a conductive plate used as the bottom electrode and mounted on a bottom of the insulation body and further having a hollow pole inserted to the first through hole, wherein a first screw is threaded into the first through hole from the top of the insulation body to the hollow pole;

an insulation plate covering the top of the insulation body and the front ends of the thin power contacts and having a hole aligned with the second hole of the insulation body; and an insulation housing covering the insulation plate, the front ends of the thin power contacts, the top and outer sides of the insulation body, and having a side opening through which the thin power contacts pass; and a through hole aligned with the hole of the insulation plate, wherein a second screw is threaded into the through hole of the insulation housing, the hole of the insulation plate, through the front end of the thin power contact and the second hole of the insulation body, wherein a top of the second screw on a top of the insulation housing is used as the top electrode.

2. The exterior power supply for hearing aid as claimed in claim 1, wherein the battery-shaped conductor is manufactured according to size of a button cell.

3. The exterior power supply for hearing aid as claimed in claim 2, wherein the DC power source is a solar power supply and comprises:

an upper housing;

a lower housing covered by the upper housing;

a PCB mounted inside the lower housing;

a power switch mounted on the PCB;

a solar panel mounted on a top of the upper housing and electronically connected to the PCB;

a rechargeable battery cell mounted inside the lower housing and electronically connected to the solar panel through the PCB and electronically connected to the power wire through the power switch and the PCB; and a regular battery mounted inside the lower housing and electronically connected to the power wire through the power switch and the PCB.

4. The exterior power supply for hearing aid as claimed in claim 3, wherein the power switch has three switching nodes, a first one is connected to the rechargeable battery cell, a second one is connected to the regular battery and a third one is a connected to a none node.

5. The exterior power supply for hearing aid as claimed in claim 4, wherein the PCB comprises:

a power charging circuit regulating output voltage of the rechargeable battery cell;

an auto loud noise control circuit electronically connected to a microphone to obtain a background noise, calculating the volume of the background noise, and controlling the background noise under 84 dB to power on or power off; and a regulator circuit having a setting voltage circuit and a voltage regulator to boost and regulate a voltage of the rechargeable battery cell to a driven voltage of the hearing aid.

6. The exterior power supply for hearing aid as claimed in claim 5, wherein the power wire further has two PVC plastic heads, and rear ends of the two thin power contacts are inserted into one of the two PVC plastic heads.

7. The exterior power supply for hearing aid as claimed in claim 6, wherein the thickness of each thin power contact is thinner than 0.1 mm.

* * * * *